US008302825B2

(12) United States Patent
Briand

(10) Patent No.: US 8,302,825 B2
(45) Date of Patent: Nov. 6, 2012

(54) DISPENSER DEVICE

(75) Inventor: Philippe Briand, Aulnay-sous-Bois (FR)

(73) Assignee: L'Oreal (FR)

( * ) Notice: Subject to any disclaimer, the term of this patent is extended or adjusted under 35 U.S.C. 154(b) by 2324 days.

(21) Appl. No.: 10/645,771

(22) Filed: Aug. 21, 2003

(65) Prior Publication Data

US 2004/0069794 A1 Apr. 15, 2004

Related U.S. Application Data

(60) Provisional application No. 60/412,781, filed on Sep. 24, 2002.

(30) Foreign Application Priority Data

Aug. 21, 2002 (FR) ..... 02 10451

(51) Int. Cl.
*B65D 47/00* (2006.01)

(52) U.S. Cl. ..... 222/548; 222/212

(58) Field of Classification Search ..... 222/212, 222/548, 554

See application file for complete search history.

(56) References Cited

U.S. PATENT DOCUMENTS

| | | | | |
|---|---|---|---|---|
| 2,717,726 | A * | 9/1955 | Mart | 222/498 |
| 3,029,003 | A * | 4/1962 | Gronemeyer | 222/545 |
| 3,258,179 | A * | 6/1966 | Cherba | 222/549 |
| 3,690,521 | A | 9/1972 | Middleton | |
| 4,308,979 | A * | 1/1982 | Otterson | 222/516 |
| 4,600,127 | A | 7/1986 | Malpas et al. | |
| 4,961,515 | A | 10/1990 | Schreiber | |
| 5,246,148 | A | 9/1993 | Slat et al. | |
| 5,303,850 | A | 4/1994 | Connan | |
| 5,358,146 | A * | 10/1994 | Stull | 222/148 |
| 5,582,315 | A * | 12/1996 | Reid | 220/254.4 |
| 6,334,556 | B1 | 1/2002 | Bougamont et al. | |
| 6,378,735 | B1 * | 4/2002 | Chu | 222/158 |

FOREIGN PATENT DOCUMENTS

| | | |
|---|---|---|
| CN | 1318026 A | 10/2001 |
| FR | 2 711 620 A1 | 5/1995 |
| JP | 60-190648 U | 12/1985 |
| JP | 2-97253 | 8/1990 |

* cited by examiner

*Primary Examiner* — Frederick C. Nicolas

(74) *Attorney, Agent, or Firm* — Lerner, David, Littenberg, Krumholz & Mentlik, LLP

(57) ABSTRACT

A dispenser is provided including a first part for fixing on a receptacle and a second part suitable for turning relative to the first part between a dispensing position in which substance contained in the receptacle can leave the device through a dispenser orifice opening out directly to the outside, and a closed position in which substance is prevented from passing from the receptacle to the dispenser orifice, wherein the dispenser orifice is formed between two surfaces belonging respectively to said two parts.

27 Claims, 2 Drawing Sheets

DISPENSER DEVICE

CROSS-REFERENCE TO RELATED APPLICATIONS

This application claims priority from French Application No. 02 10451 filed on Aug. 21, 2002 and U.S. Provisional Application No. 60/412,781 filed on Sep. 24, 2002.

FIELD OF THE INVENTION

The present invention relates to devices for dispensing a fluid, in particular a cosmetic or a care product.

BACKGROUND OF THE INVENTION

Dispenser devices comprising a rotary part that can be actuated to close or open communication between the inside of a receptacle and a dispenser orifice are known, in particular from U.S. Pat. Nos. 648,278, 3,690,521, 4,961,515, 5,246,148, and 5,303,850. The dispenser devices described in those U.S. patents are not designed to prevent impurities such as grains of sand from penetrating into the inside, and they are not entirely appropriate for dispensing a cosmetic or care product suitable for use on a beach, for example a sunscreen.

French Patent No. 2,711,620 proposes a dispenser device also known as a "clean capsule" having a dispenser orifice that is provided with a check valve made of elastomer material for the purpose of preventing impurities such as grains of sand from penetrating into the inside. Nevertheless, such a dispenser device is relatively complex and expensive to make.

There thus exists a need for further improvement in devices for dispensing a fluid substance, in particular by making them easier to manufacture, and in particular when they are intended for dispensing a sunscreen.

SUMMARY OF THE INVENTION

In accordance with the present invention this need has been satisfied by means of a dispenser comprising a first part for fixing on a receptacle and a second part suitable for turning relative to the first part between a dispensing position in which substance contained in the receptacle can leave the device through a dispenser orifice opening out directly to the outside, and a closed position in which a substance is prevented from passing from the receptacle to the dispenser orifice, which device is characterizable by the fact that the dispenser orifice is formed between two surfaces belonging respectively to these two parts.

Between them, these two surfaces leave a clearance which can be selected to be sufficiently narrow, for example less than or equal to 0.5 millimeters (mm), or even about 0.2 mm, so as to prevent sand from penetrating into the inside of the device.

By means of the present invention, the dispenser device can be made at relatively low cost since the dispenser orifice does not have a check valve of elastomer material. The present invention also makes it possible to avoid any problem associated with aging of the check valve material or of compatibility between that material and the substance being dispensed. The present invention also makes it possible to have a dispenser orifice that is clean in appearance, since its surroundings are easy to clean. The fact that the first and second parts need to be turned relative to each other in order to be brought into a dispensing position makes it possible to reduce any risk of the device opening accidentally, e.g. in a handbag.

The above-mentioned surfaces may be concentric. The dispenser orifice may be defined at least in part by a gap in the form of an angular sector. In a preferred embodiment of the present invention, the dispenser orifice is open to the outside in a direction parallel to the pivot axis of the second part.

The dispenser orifice may be made substantially at the top end of the device when the receptacle fitted with the device is standing on a horizontal plane surface.

The second part may have a top wall provided with an opening whose edge, e.g. an edge of circular shape, defines one of said surfaces, while the first part may have an end wall engaged in the opening of the second part and whose edge, e.g. an edge of circular shape, defines the other one of said surfaces. Said top wall may not be a circular cylinder.

The end wall and the top wall may advantageously present outside surfaces which extend one another substantially (ignoring the dispenser orifice). This contributes to improving the appearance of the dispenser device and can make it easier to clean the vicinity of the dispenser orifice.

The first and second parts may usefully be made by being molded out of plastics materials having different colors, thus making it easy for a user to identify the location of the dispenser orifice.

The dispenser orifice may be located away from the center of the top wall of the second part, for example in order to allow the second part to turn about a pivot axis that is inclined and/or in order to benefit from a larger area on which the substance can accumulate prior to being taken by the user.

In the dispensing position, and when the receptacle fitted with the dispenser device is standing on a horizontal plane surface, the top wall of the second part may be inclined. The substance leaving the dispenser orifice may tend to flow under gravity downwards over the top wall of the second part if that substance is sufficiently fluid. The fact of having the dispenser orifice off-center can make it possible to increase the size of the surface onto which the substance can flow before leaving the top wall, thus making it easier to take the substance.

The spacing between the two surfaces defining the dispenser orifice may be constant. The spacing may also be non-constant, for example in order to cause the substance to be dispensed preferentially from a region of the dispenser orifice in which the spacing is at a maximum, when the two parts are in the dispensing position.

The first part may include a tubular extension that is closed at its top end by the above-mentioned top wall, that extension being provided with at least one lateral opening, and the second part may include an inner skirt configured firstly to close the lateral opening when the two parts are in the closed position and secondly to allow the substance to pass through the lateral opening towards the dispenser orifice when the two parts are in the dispensing position.

The dispenser orifice may communicate with a chamber formed between the first and second parts when these parts are in the dispensing position. The chamber may occupy an angular sector around the pivot axis of the second part, which sector is less than one complete turn. The chamber may be formed, for example, between a setback in the tubular extension and a notch extending axially in the radially inner surface of the inner skirt of the second part. The volume of the chamber is preferably small enough to prevent substance accumulating that might subsequently dry out in the absence of use. The volume and the configuration of the chamber may be selected in such a manner that substantially all of the substance contained therein can be sucked back into the receptacle during an ingress of air that accompanies the receptacle returning to its initial shape, assuming that the receptacle is of variable volume and has shape memory.

The above-mentioned lateral opening may be defined by an annular lip extending from a setback in the tubular extension. This annular lip may define an annular slot between itself and the inside of the setback.

The pivot axis of the second part may be inclined relative to the axis of a skirt of the first part used for mounting on the receptacle, the axis of the skirt possibly coinciding with the axis of a neck of the receptacle. The pivot axis of the second part need not be vertical when the receptacle which is fitted with the dispenser device is standing on a horizontal plane surface. The inclination of the pivot axis may make it easier for the user to identify the dispensing position relative to the closed position. The pivot axis may be contained in a vertical plane when the receptacle which is fitted with the dispenser device is standing on a horizontal plane surface.

The first and second parts may be configured so that passage from the closed position to the dispensing position is performed by turning the second part relative to the first part through at least one-fourth of a turn, for example through half a turn, however such passage may be achieved in some other way.

The first and second parts may be configured so as to be prevented from moving axially relative to each other. One of these two parts may be snap-fastened on the other part, and with at least one of these two parts having a bead or a groove on the same axis as the pivot axis of the second part. For example, one of the two parts may have an annular bead and the other at least one portion in relief configured to snap-fasten on the annular bead during manufacture of the dispenser device. The two parts may be in fixed axial position relative to the pivot axis of rotation of one of the parts relative to the other. The dispenser orifice may have an axis along which the substance is dispensed and the first and second parts may be prevented from moving axially relative to said axis.

The first and second parts need not have any hinges connecting them together. The dispenser orifice may be permanently formed between the surfaces belonging respectively to the first and second parts, regardless of whether the dispenser device is in the dispensing position or the closed position.

The present invention also provides, according to one of its aspect, alone or in combination with the features described above, a device comprising a first part for fixing on a receptacle and a second part suitable for turning relative to the first part between a dispensing position in which substance contained in the receptacle can leave the device through a dispenser orifice opening out directly to the outside, and a closed position in which substance is prevented from passing from the receptacle to the dispenser orifice, wherein the dispenser orifice is formed between two surfaces belonging respectively to these two parts, the first and second parts comprising portions comprising outer surfaces, one of the surfaces being the continuation of the other.

The present invention also provides, according to one of its aspects, alone or in combination with the features described above, a device comprising a first part for fixing on a receptacle and a second part suitable for turning relative to the first part between a dispensing position in which a substance contained in the receptacle can leave the device through a dispenser orifice opening out directly to the outside, and a closed position in which the substance is prevented from passing from the receptacle to the dispenser orifice, wherein the dispenser orifice is formed between two surfaces belonging respectively to said two parts, one of said surfaces being carried in rotation around the other.

The present invention also provides, according to one of its aspects, alone or in combination with the features described above, a device comprising a first part for fixing on a receptacle and a second part suitable for turning around an axis of rotation relative to the first part between a dispensing position in which substance contained in the receptacle can leave the device through a dispenser orifice opening out directly to the outside, and a closed position in which substance is prevented from passing from the receptacle to the dispenser orifice, wherein the dispenser orifice is formed between two surfaces belonging respectively to the two parts, the axis of rotation being sloped relative to a longitudinal axis of the receptacle.

The present invention also provides a receptacle fitted with a dispenser device as defined above. The receptacle may be made by molding material in a mold that defines a join plane, the receptacle comprising a body with a top wall.

Advantageously, the top wall includes at least one step extending along the join plane over at least the major portion of the distance between the neck and the periphery of the top wall.

Such a step serves to reinforce the strength of the top wall, in particular relative to the stresses that are exerted while the dispenser device is being fixed on the top wall.

For equivalent strength, it is thus possible to reduce the thickness of material used, or for equal thickness of material, it is possible to withstand greater levels of stress and to increase rates of manufacturing throughput, for example.

BRIEF DESCRIPTION OF THE DRAWINGS

The present invention can be better understood on reading the following detailed description of a non-limiting embodiment, and on examining the accompanying drawings, in which.

DETAILED DESCRIPTION

Figure 1:
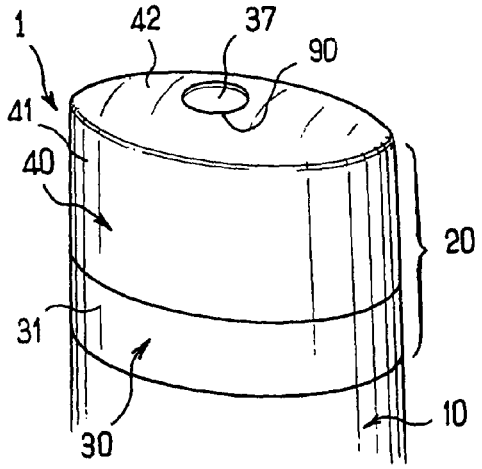
FIG. 1 is a side, perspective, fragmentary and view of a packaging and dispenser device constituting an embodiment of the present invention.
Figure 2:
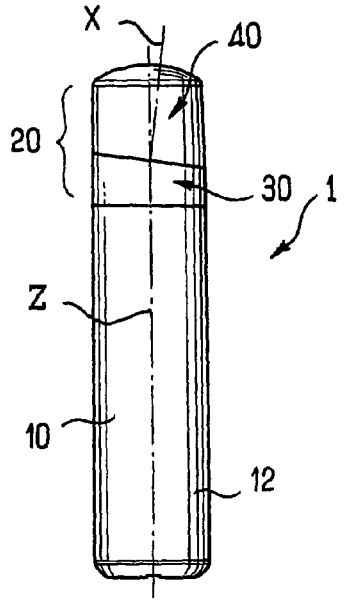
FIG. 2 is a side elevational view of the device shown in FIG. 1.

The packaging and dispenser device 1 shown in the figures comprise a receptacle 10 having a neck 11 of axis Z and a dispenser device 20 made up of two parts, namely a first part 30 for fixing on the receptacle 10 by snap-fastening and a second part 40 capable of turning in either direction relative to the first part 30 about a pivot axis X which is at an angle of less than 45° relative to the axis Z in the example described, for example at an angle of a little less than 10°. In the example described, the first and second parts 30 and 40 are made of non-elastomeric plastics materials of different colors.

The receptacle 10 may comprise a body 12 of oblong cross-section, and specifically of elliptical cross-section in the example described.

Figure 5:
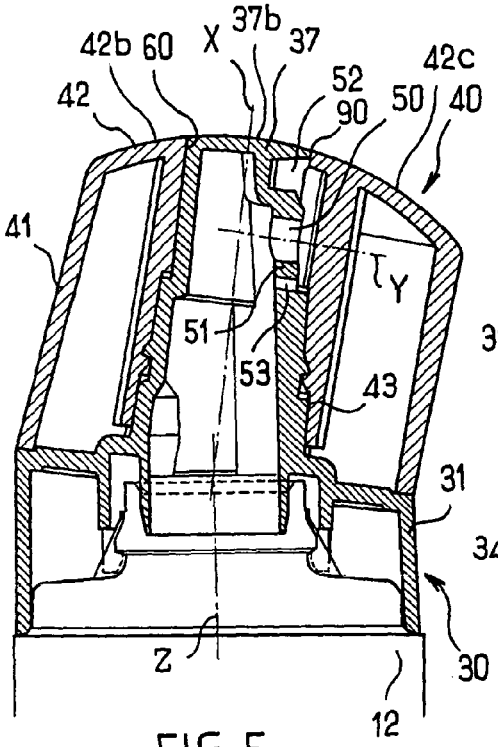
FIG. 5 is a side, elevational, partial, sectional view of the dome shown in FIG. 1 in its dispensing position.
Figure 4:
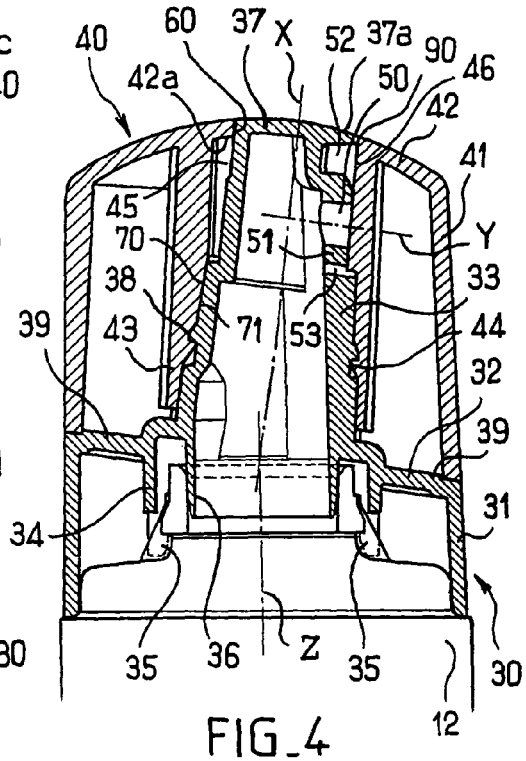
FIG. 4 is a side, elevational, partial, sectional view of the device shown in FIG. 1*n* its closed position.

As can be seen in FIGS. 4 and 5 in particular, the first part 30 comprises a tubular outer skirt 31 designed to occupy a position in which it extends the outer surface of the receptacle 10.

A transverse wall 32 extending generally perpendicularly to the axis X extends the top of the outer skirt 31 inwardly and supports a tubular extension 33 about the axis X which has its base connected to the transverse wall 32.

The first part 30 also comprises an assembly skirt 34 extending inside the outer skirt 31 and including on its radially inner surface two teeth 35 each in the form of a circular arc and designed to catch on a portion in relief on the neck 11, as described in greater detail below, and also a sealing lip 36 for pressing against the radially inner surface of the neck 11.

Figure 3:
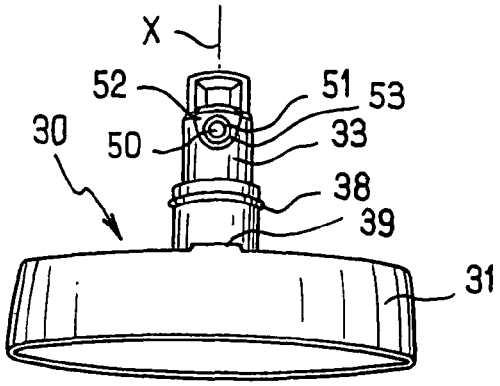
FIG. 3 is a front, perspective view of the first part of the dispenser device, ready for fixing on the receptacle.

An annular bead 38 is made on the extension 33 and the top end of the extension is closed by an end wall 37. The extension 33 has a lateral opening 50 defined by an annular lip 51 about an axis Y perpendicular to the axis X. The annular lip 51 extends from a setback 52, as can be seen in FIG. 3. An annular slot 53 is formed around the annular lip 51 in the setback 52. The top of the setback is defined by a portion 37*a* of the end wall 37.

The end wall 37 presents an edge which is circular about the axis X and which defines a cylindrical surface 60 having generator lines parallel to the axis X.

The second part 40 comprises an outer skirt 41 which surrounds the extension 33 and which is connected to a top wall 42.

The transverse wall 32 has two thin splines 39 extending parallel to the minor axis of the transverse wall 32. These two splines 39 are for co-operating with axial ribs (not shown in the drawings) formed on the radially inner surface of the outer skirt 41 so as to create a hard point in the turning movement of the second part 40 and so as to make it easier to position it so that it extends the outer skirt 31 of the first part 30.

The second part 40 also has an inner skirt 43 configured for fixing on the extension 33. For this purpose, the inner skirt 43 has an annular rib 44 configured to snap-fasten on the annular bead 38.

On its radially inner surface, the inner skirt 43 presents a notch 45 which extends axially and which is of a width that is slightly greater than the outside diameter of the annular lip 51. The top of the notch 45 is defined by a portion 42*a* of the top wall 42. Outside the notch 45, the inner skirt 43 presents an inside surface 46 that is circularly cylindrical about the axis X. The annular lip 51 bears in leaktight manner against said inside surface 46 when the dispenser device is in its closed position, as can be seen in FIG. 4, thereby closing the lateral opening 50.

The inner skirt 43 and the extension 33 have respective slightly conical surfaces 70 and 71 which provide assembly sealing between the second part 40 and the first part 30 so as to prevent substance from running out downwards between the extension 33 and the inner skirt 43. The top wall 42 presents an opening whose edge is circular about the axis X in the example described, defining a cylindrical surface 80 having generator lines parallel to the axis X. The surface 80 co-operates with the facing surface 60 of the end wall 37 to define an annular space having an angular sector that defines a dispenser orifice 90 through which the substance can leave the dispenser device.

Figure 7:
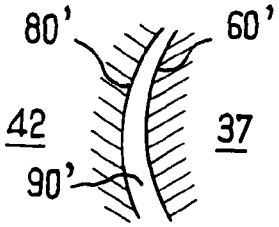
FIG. 7 is a top, elevational, fragmentary diagrammatic view analogous to FIG. 6 showing another embodiment of the dispenser orifice used in the present invention.

In the example described, the spacing between the facing surfaces 60 and 80 is of a size j that is substantially constant regardless of whether or not substance is being dispensed, however it would not go beyond the ambit of the present invention for this spacing to vary circumferentially. By way of example, FIG. 7 shows a dispenser orifice 90' defined between two facing surfaces 60' and 80' belonging respectively to the first and second parts and that are not circular about a common axis.

In FIGS. 4 and 5, it can be seen in particular that the top wall 42 and the end wall 37 present respective top surfaces 42*b* and 37*b* which extend each other (ignoring the annular gap that exists between them), thereby making it easier to clean the vicinity of the dispenser orifice 90.

Figure 8:
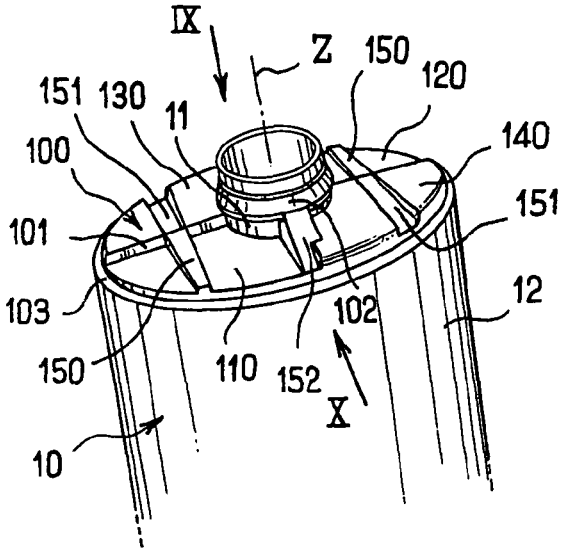
FIG. 8 is a side, perspective, partial view of a receptacle used in the present invention.

The receptacle 10 may advantageously present a top portion that is reinforced, as described below with reference to FIGS. 8 to 10.

The neck 11 is connected to a top wall 100 of the receptacle, the top wall being of elliptical outline in the example described, and extending generally transversely to the axis Z of the neck 11.

In the example described, the receptacle 10 is made by blowing a plastic material in a two-part mold, and the join plane P of the mold coincides with the major axis of the oblong section of the body 12 and of the top wall 100. The existence of the join plane P can be made visible on the body 12 of the receptacle by a bead of material projecting very slightly from its outside surface.

A setback 101 is formed in the join plane P to constitute a portion in relief forming a kind of stiffening "beam" in the top wall 100, thus making it possible, for example, to use a relatively small thickness of material while still having a receptacle that is capable of withstanding the stresses that are exerted thereon while the dispenser device is being fixed by tooling operating at a high rate of throughput. In the example shown, such fixing is performed by snap-fastening the teeth 35 on an annular bead 102 of the neck 11.

In the example described, the step 101 extends from the periphery of the top wall 100, which has a ledge 103, to the base of the neck 11, and forms part of the boundaries defining four regions 110, 120, 130, and 140 of the top wall 100.

Each region 110, 120, 130, or 140 occupies substantially one-fourth of the top wall 100, each fourth being defined by the intersection of a half-plane situated on one side of the join plane P and a half-plane situated on one side of the midplane M perpendicular to the join plane and containing the axis Z.

The two regions 110 and 120 are situated diametrically opposite each other about the axis Z and they occupy substantially the same axial position along the axis Z. The two regions 130 and 140 are also situated diametrically opposite each other about the axis Z and they are offset axially relative to the regions 110 and 120, being nearer to the free end of the neck 11 by a distance which corresponds substantially to the height of the step 101 as measured parallel to the axis Z.

The top wall 100 also has portions in relief which extend transversely to the join plane P.

More particularly, in the example described, the top wall 100 has two ribs 150 that are symmetrical to each other about the axis Z and that extend respectively in the regions 110 and 120, these ribs 150 having longitudinal axes parallel to the midplane M. The ribs 150 are of height measured parallel to the axis Z that increases linearly from a value of substantially zero starting at the ledge 103 at the periphery of the top wall 100 and going towards the step 101 to which they are connected, and a width which increases slightly on approaching the step 101.

The top wall 100 also has two grooves 151 situated in line with respective ones of the two ribs 150, each groove 151 having a longitudinal axis which extends along a direction that is generally perpendicular to the join plane P. The grooves 51 are of depth that increases linearly on going away from the step 101.

Figure 9:
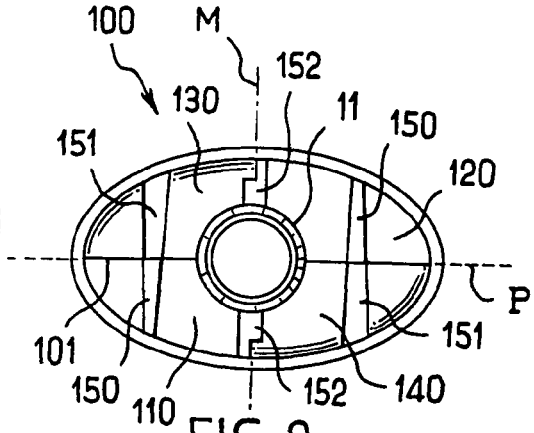
FIG. 9 is a top plan view taken along arrow IX of FIG. 8.
Figure 10:
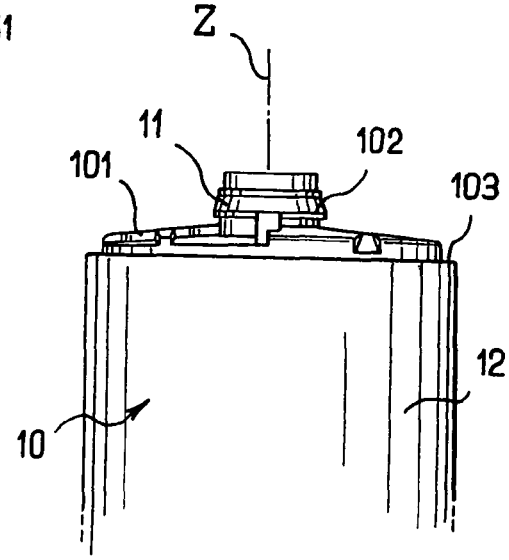
FIG. 10 is a side, elevational, fragmentary view taken along arrow X of FIG. 8.
Figure 6:
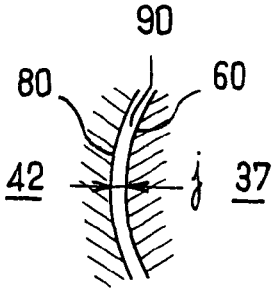
FIG. 6 is a top, elevational, fragmentary, diagrammatic view on a larger scale showing the dispenser orifice used in the present invention.

The width of each groove 151 increases slightly on approaching the periphery of the top wall 100, the longitudinal edges of the grooves 151 being rectilinear and situated in line with the likewise rectilinear edges of the ribs 150 when the top wall 100 is observed from above, as can be seen in FIG. 9.

The top wall 100 also has two ribs 152 that are diametrically opposite about the axis Z, extending perpendicularly to the join plane P between the neck 11 and the periphery of the top wall 100 in the region of the minor axis thereof.

The height of the ribs 152 as measured parallel to the axis Z increases linearly on approaching the neck 11 from a value that is substantially zero at the periphery of the top wall 100.

The dispenser device operates as follows.

In the closed position, the lateral opening 50 is closed by the inner skirt 43 so that the dispenser orifice 90 does not communicate with the inside of the receptacle 10.

A user can bring the dispenser device into a dispensing position by causing the second part 40 to turn through half a turn relative to the first part 30.

This turning movement brings the notch 45 of the inner skirt 43 into register with the setback 52, thereby creating a chamber enabling the substance to flow from the lateral opening 50 towards the dispenser orifice 90.

The substance can then flow towards the outlet, for example under drive from pressure exerted on the deformable wall of the body 12 of the receptacle 10 seeking to reduce its inside volume, or else by turning the receptacle into a head-down position, if the substance is sufficiently fluid.

On examining FIG. 5, it can be seen that when the outer skirt 41 of the second part 40 is in the dispensing position, it is at an angle with the outer skirt 31 of the first part 30, thereby making it easier for the user to see a change in the state of the dispenser device.

Once dispensing has come to an end, air ingress can take place, for example because of the body 12 of the receptacle 10 having shape memory. Given the small spacing that exists between the end wall 37 and the top wall 42, any substance present in the dispenser orifice 90 can be sucked back in.

Naturally, the invention is not limited to the embodiment described above.

In particular, the dispenser orifice may be centered on the top wall of the second part and the receptacle may present a body that is tubular and circular in section, for example. The facing surfaces of the first and second parts which define the dispenser orifice could be other than circularly cylindrical without going beyond the ambit of the present invention. The end wall 37 and the corresponding opening made in the top wall 42 may have edges that are chamfered or rounded in axial section, for example.

Throughout the description, including in the claims, the term "comprising a" should be understood as being synonymous with "comprising at least one" unless specified to the contrary.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A receptacle containing a cosmetic or care substance including a dispenser comprising:

a first part having a first surface, said first part being attached to the receptacle; and a second part having a second surface, whereby a dispenser orifice is formed between said first and second surfaces, said second part adapted for rotational mounting relative to said first part, said second part capable of rotating between a dispensing position and a closed position, said dispensing position capable of permitting a substance contained in the receptacle to exit through said dispenser orifice, said dispenser orifice opening out directly to the environment, and said closed position capable of preventing a substance contained in the receptacle from passing from the receptacle to said dispenser orifice.

2. A receptacle according to claim 1, wherein said first and second surfaces are spaced apart by a distance, said distance being sufficiently small to prevent sand from penetrating into an interior of the receptacle.

3. A receptacle according to claim 2, wherein said distance between first and second surfaces is less than 0.5 mm.

4. A receptacle according to claim 1, wherein said dispenser orifice is defined at least in part by a gap, said gap being in the form of an annular sector.

5. A receptacle according to claim 1, wherein said second part comprises a top wall, said top wall being provided with an opening, said opening comprising an edge, said edge defining one of said first and second surfaces, and wherein said first part comprises an end wall, said end wall engaged with said opening in said second part, said end wall comprising an edge, said edge defining the other one of said first and second surfaces.

6. A receptacle according to claim 5, wherein said dispenser orifice is eccentric in said top wall.

7. A receptacle according to claim 1, wherein said first and second surfaces are concentric and circular in section.

8. A receptacle according to claim 1, wherein said first part comprises a tubular extension, said tubular extension including a closed top end and provided with at least one lateral opening, and wherein said second part comprises an inner skirt, said inner skirt configured to close said lateral opening when said first and second parts are in said closed position, said inner skirt also configured to allow substance to pass from said lateral opening to said dispenser orifice when said first and second parts are in said dispensing position.

9. A receptacle according to claim 1, including a chamber formed between said first and second parts when the receptacle is in said dispensing position, said dispenser orifice communicating with said chamber.

10. A receptacle according to claim 9, wherein said second part includes an axis of rotation, and said chamber extends over an angular sector about said axis of rotation, said angular sector being less than one complete revolution of said second part.

11. A receptacle according to claim 1, wherein said second part includes a pivot axis, and said receptacle includes a neck including an axis, and wherein said pivot axis is located at a point on said second part and is inclined relative to said axis of said neck.

12. A receptacle according to claim 1, wherein said first and second parts are configured so as to pass from said closed position to said dispensing position by rotating said second part through a half turn.

13. A receptacle according to claim 1, wherein said first and second parts are configured to be prevented from moving axially relative to each other.

14. A receptacle according to claim 1, wherein the receptacle does not include a check valve.

15. A receptacle according to claim 1, wherein said first and second parts are made of plastic material of different colors.

16. A receptacle according to claim 1, wherein said substance is a sunscreen or an after-sun lotion.

17. A receptacle according to claim 1, wherein said dispenser orifice is in a fixed position independent from said second part.

18. A receptacle according to claim 1, wherein said receptacle further comprises a surface being in communication with said environment upon which said substance is dispersed upon dispensing from said dispenser orifice.

19. A device comprising:

a first part having a first surface, said first part for attaching to a receptacle; and a second part having a second surface, whereby a dispenser orifice is formed between said first and second surfaces, said second part adapted for rotational movement relative to said first part, said second part capable of rotating between a dispensing position and a closed position, said dispensing position capable of permitting a substance contained in said receptacle to leave the device through said dispenser orifice, said dispenser orifice opening out directly to the environment, and said closed position capable of preventing said substance contained in the receptacle from passing from said receptacle to said dispenser orifice, said first and second parts further comprising first and second portions, said first and second portions comprising first and second outer surfaces, one of said first and second outer surfaces being the continuation of the other of said first and second outer surfaces.

20. A device according to claim 19, wherein said dispenser orifice is in a fixed position independent from said second part.

21. A device according to claim 19, wherein said device further comprises a surface being in communication with said environment upon which said substance is dispersed upon dispensing from said dispenser orifice.

22. A device containing a cosmetic or care substance including a dispenser comprising:

a first part having a first surface, said first part adapted for attachment to a receptacle; and a second part including a second surface, whereby a dispenser orifice is formed between said first and second parts, said second part adapted for rotational mounting relative to said first part, said second part capable of rotating between a dispensing position and a closed position, said dispensing position capable of permitting a substance contained in the receptacle to leave the receptacle through said dispenser orifice, said dispenser orifice opening out directly to the environment; and said closed position preventing said substance contained in the receptacle from passing from the receptacle to said dispenser orifice, one of said first and second surfaces being rotatable around the other of said first and second surfaces.

23. A device according to claim 22, wherein said dispenser orifice is in a fixed position independent from said second part.

24. A device according to claim 22, wherein said device further comprises a surface being in communication with said environment upon which said substance is dispersed upon dispensing from said dispenser orifice.

25. A device containing a cosmetic or care substance including a dispenser comprising:

a first part including a first surface and an axis of rotation, said first part being attached to a receptacle having a longitudinal axis; and a second part including a second surface, whereby a dispenser orifice is formed between said first and second surfaces, said second part adapted for rotational mounting relative to said axis of rotation, said second part capable of rotating between a dispensing position and a closed position, said dispensing position capable of permitting a substance contained in the receptacle to leave the device through said dispenser orifice, said dispenser orifice opening out directly to the environment, said closed position capable of preventing said substance contained in the receptacle from passing from the receptacle to said dispenser orifice, said axis of rotation being sloped relative to said longitudinal axis.

26. A device according to claim 25, wherein said dispenser orifice is in a fixed position independent from said second part.

27. A device according to claim 25, wherein said device further comprises a surface being in communication with said environment upon which said substance is dispersed upon dispensing from said dispenser orifice.

* * * * *